US006151779A

United States Patent [19]

Brown

[11] Patent Number: 6,151,779

[45] Date of Patent: Nov. 28, 2000

[54] COIN ROLL OPENER

[76] Inventor: Roger Brown, 1476 190th Ave., Balsam Lake, Wis. 54810

[21] Appl. No.: 09/322,730

[22] Filed: May 28, 1999

[51] Int. Cl.[7] ..... B26B 27/00

[52] U.S. Cl. ..... 30/2; 30/1.5; 30/102

[58] Field of Search ..... 30/1.5, 2, 92, 94, 30/101, 102, 299, 306, 307, 293, 294, 278, 280

[56] References Cited

U.S. PATENT DOCUMENTS

| | | | |
|---|---|---|---|
| 1,806,475 | 5/1931 | Lee | 30/1.5 |
| 3,781,987 | 1/1974 | Gentscheff | 30/2 |
| 4,001,934 | 1/1977 | Bell | 30/124 |
| 4,040,183 | 8/1977 | Cassier | 30/296 R |
| 4,333,234 | 6/1982 | Smith et al. | 30/2 |
| 4,382,330 | 5/1983 | Harbaugh | 30/124 |
| 4,757,611 | 7/1988 | Tommi et al. | 30/2 |
| 4,825,738 | 5/1989 | Jones | 83/56 |
| 4,852,253 | 8/1989 | Uchida | 30/2 |
| 4,852,255 | 8/1989 | Hochfeld | 30/102 |
| 5,123,320 | 6/1992 | Hochfeld | 83/856 |
| 5,653,023 | 8/1997 | Andina | 30/1.5 |
| 5,659,963 | 8/1997 | McCrady | 30/307 |
| 5,964,388 | 10/1999 | Jennings et al. | 30/2 |

*Primary Examiner*—Hwei-Siu Payer
*Attorney, Agent, or Firm*—Jacobsen & Johnson

[57] ABSTRACT

A coin holder opener having a housing with a central axis and a set of rollers rotatably mounted at an acute angle with respect to the housing and in a spaced relationship from each other and a central axis so that when a roll of wrapped coins are inserted into pressure contact and rotated, the rollers force the wrapper against an edge of a coin to compressively cut the coin wrapper located therebetween.

14 Claims, 6 Drawing Sheets

COIN ROLL OPENER

FIELD OF THE INVENTION

This invention relates generally to coin holder opening devices and more specifically to coin holder opening devices that do not require a cutting blade.

BACKGROUND OF THE INVENTION

The concept of coin holder opening devices is known in the art and generally includes some type of knife or blade that is used to sever the wrapper located around the coin roll. As a blade has a potential to injure a person, it is desired to have a coin holder opening device that does not use an exposed blade to sever the coin wrapper. The present invention provides a coin wrapper severing device that instead of using a knife includes members that utilize the edge of the coin to sever the coin wrapper. A further feature of the invention is that when the coin holder opener is incorporated to a power stand, a roll of coins can be opened by merely axially inserting the roll of coins into a chamber in the coin holder opener housing.

DESCRIPTION OF THE PRIOR ART

U.S. Pat. No. 4,001,934 shows a coin holder opener with a bifurcated channel containing a blade therein for opening coin rolls.

U.S. Pat. No. 4,040,183 shows a coin holder opener which is in an "L" shape that utilizes the longitudinal rolling motion of a coin holder along the "L" to open the roll.

U.S. Pat. No. 4,382,330 shows a coin holder opener that uses spring action blades to sever the top of a coin roll.

U.S. Pat. No. 4,757,611 shows a palm sized coin holder opener with a depressable guard that when pressed, exposes a blade to cut coin rolls.

U.S. Pat. No. 4,825,738 shows a coin holder opener that utilizes rotating motion along an edge to open a coin roll.

U.S. Pat. No. 4,852,253 shows a coin holder opener which uses two paired blades.

U.S. Pat. No. 5,123,320 shows a coin holder opener which has a slightly annular shape and a recessed blade to cut open coin rolls.

U.S. Pat. No. 5,659,963 shows a coin holder opener that functions when a user exerts squeezing pressure on the handles of the coin roller.

SUMMARY OF THE INVENTION

A coin holder opener for automatically opening a roll of coins with the coin holder opener having a housing with a central axis and a set of rollers rotatably mounted at an acute angle with respect to the housing and in a spaced relationship from each other and the central axis so that when a roll of wrapped coins are inserted axially into pressure contact with the rollers and rotated thereabouts, the force of the wrapper against the edge of a coin severs the coin wrapper located between the roller and the edge of the coin to free the coins from the coin holder.

BRIEF DESCRIPTION OF THE DRAWINGS

FIG. 2*a* is a top view of the coin holder opener of FIG. 1 showing the information area for carrying promotional information or the like;

DESCRIPTION OF THE PREFERRED EMBODIMENT

Figure 1:
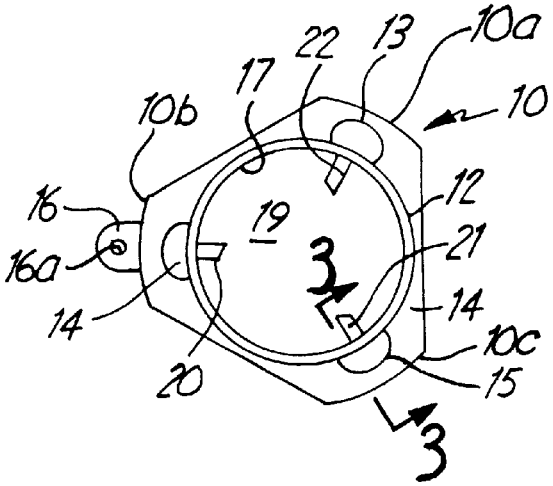
FIG. 1 is bottom view of my coin holder opener.
Figure 2:
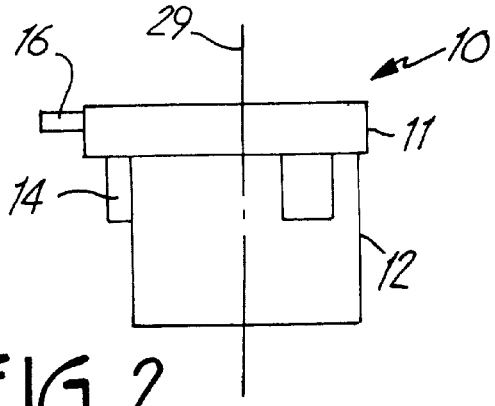
FIG. 2 is a side view of my coin holder opener of FIG. 1.

FIG. 1 is bottom view of my coin holder opener 10 and FIG. 2 is a side view of my coin holder opener. Coin holder opener 10 comprises a generally triangular base 11 and a cylindrical sidewall 12 having an interior chamber 19 for receiving a roll of wrapped coins. A set of three rotatable rollers 20, 21 and 22 are located in the housing and respectively have reinforcing buttress 14, 15 and 13. The coin holder housing is preferably made of a polymer plastic and the rollers are preferably made of metal although it is envisioned that other materials could be used as long as the materials could provide the necessary compressive support for the operation of the coin holder opener. An extension 16 with an opening 16*a* is included so the coin holder opener can be attached to an object or a person for easy access. Located on the sides of the housing are protrusions 10*a*, 10*b* and 10*c* to assist one in griping the housing for rotation thereabouts.

FIG. 2 shows that coin holder opener 10 includes a central axis 29 that extends axially though the center of coin holder opener 10.

Figure 2A:
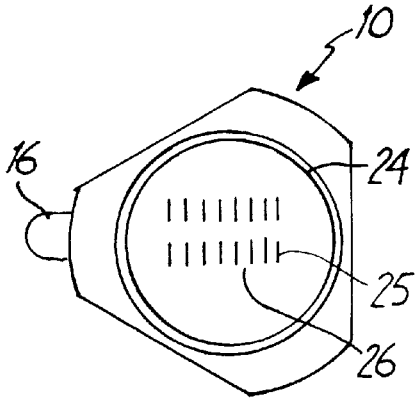

FIG. 2*a* shows a top view of the coin holder opener 10 that includes a raised ring 24 defining a central information area 26 with visual information 25 located thereon. That is, the central area 26 can carry promotional information on a product or a service. Thus the present invention can be used as a promotional item since the item can carry promotional information as well as performing a useful function.

Figure 3:
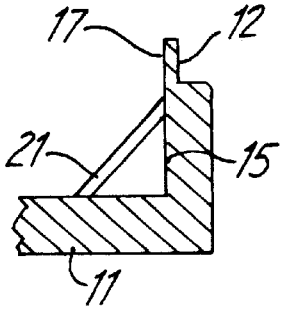
FIG. 3 is a partial sectional view taken along lines 3—3 of FIG. 1.

FIG. 3 is a partial sectional view taken along lines 3—3 of FIG. 1 to reveal that roller 21 is mounted at an acute angle to wall 17 with one end extending into base 11 and the other end into side wall 12. As the other rollers (20, 22) are mounted in an identical manner, they are not shown in detail herein.

Figure 4:
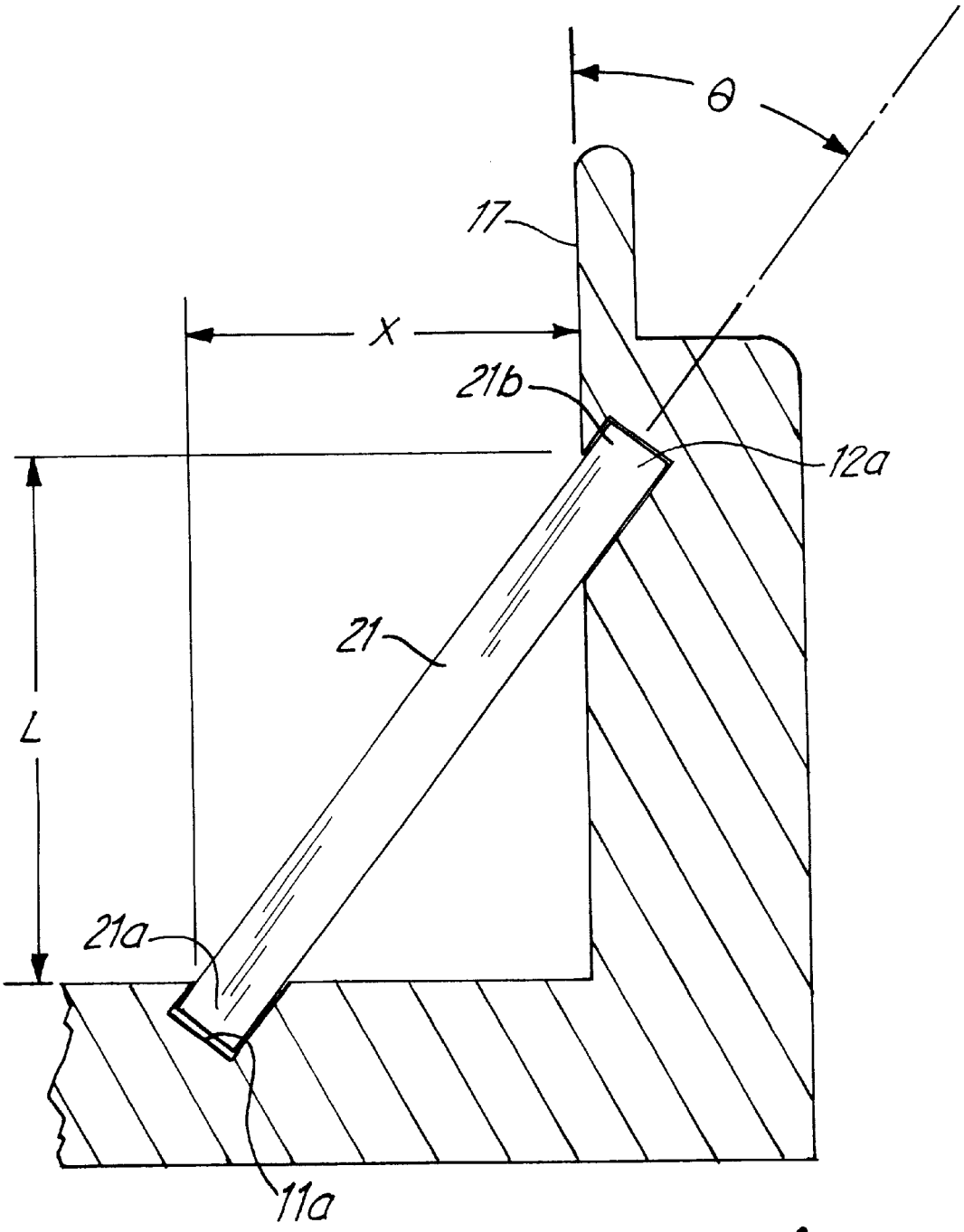
FIG. 4 is an enlarged sectional view of FIG. 3 illustrating the mounting supports for the rotatable rollers.

FIG. 4 is an enlarged sectional view similar to FIG. 3 which shows the integral mounting supports for the rotatable roller 21. That is, one end of roller 21*a* is rotatably mounted in a cylindrical recess 11*a* and the other end 21*b* is similarly mounted in a cylindrical recess 12*a* to thereby support the rotatable roller 21 in a rotatable condition. In the embodiment shown, three rollers are shown although it is envisioned that more or less rollers could be used. Three rollers are preferred as the members will provide support for the flat end of a coin roll and ensure that each of the rollers will be in contact with the coin holder placed therein. While it is envisioned that the rollers need not be rotatable, the rotatable rollers reduce the resistance to rotating the coin holder with respect thereto. If the material used for housing 10 is a polymer plastic, the polymer plastic generally provides a low friction supporting surface that permits rotation of the roller thereon. As the other rollers are mounted in an identical manner they will not be describe herein.

FIG. 4 shows that the roller 21 extends vertically upward a distance L and laterally a distance "x". The roller 21 forms an acute angle ø with respect to central axis 29 which is parallel to wall 17. In the preferred embodiment, the angle is preferably in the range of 15 to 45 degrees. If the angle is too small the coins can wedge therebetween and become difficult to turn. On the other hand, if the angle is too large the roller will not properly force the wrapper into the peripheral edge of the coin. In operation, the edge of a coin holder needs to engage the roller 21 along the longitudinal peripheral surface of roller 21 and similarly, the coin holder needs to engage rollers 20 and 22 so that the axial and radial support for the coin holder is provided by each of the three rollers 20, 21, and 22.

Figure 5A:
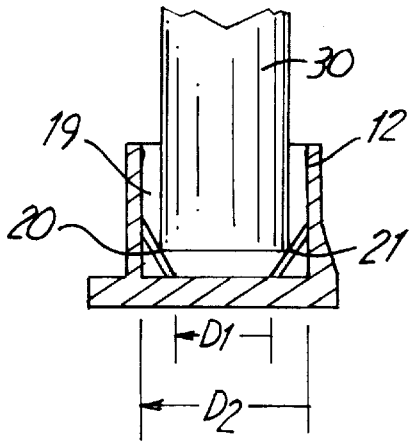
FIG. 5*a* shows a coin holder with a roll of coins being axially positioned within chamber 19.

FIG. 5*a* shows a coin holder 30 located in chamber 19 of coin holder opener 10, which is shown in section to reveal two of the three rollers. It will be apparent that the peripheral edge of the coin holder 30 will be engagement with all three rollers if the end of the coin holder is flat. It should be pointed out that having the rollers at an angle has the added benefit of making a coin opener suitable for use with differently sized coins. In the embodiment shown in FIG. 5*a*, the minimum diameter between rollers is indicated by $D_1$ and the maximum distance between rollers is indicated by $D_2$. If the roll of coins has a diameter between $D_1$ and $D_2$, the coin roller can be used to open coin roll having any diameter between $D_1$ and $D_2$. For example, a roll of nickels or quarters could be opened with the same coin holder opener, since either of the roll would engage the rollers.

Figure 5:
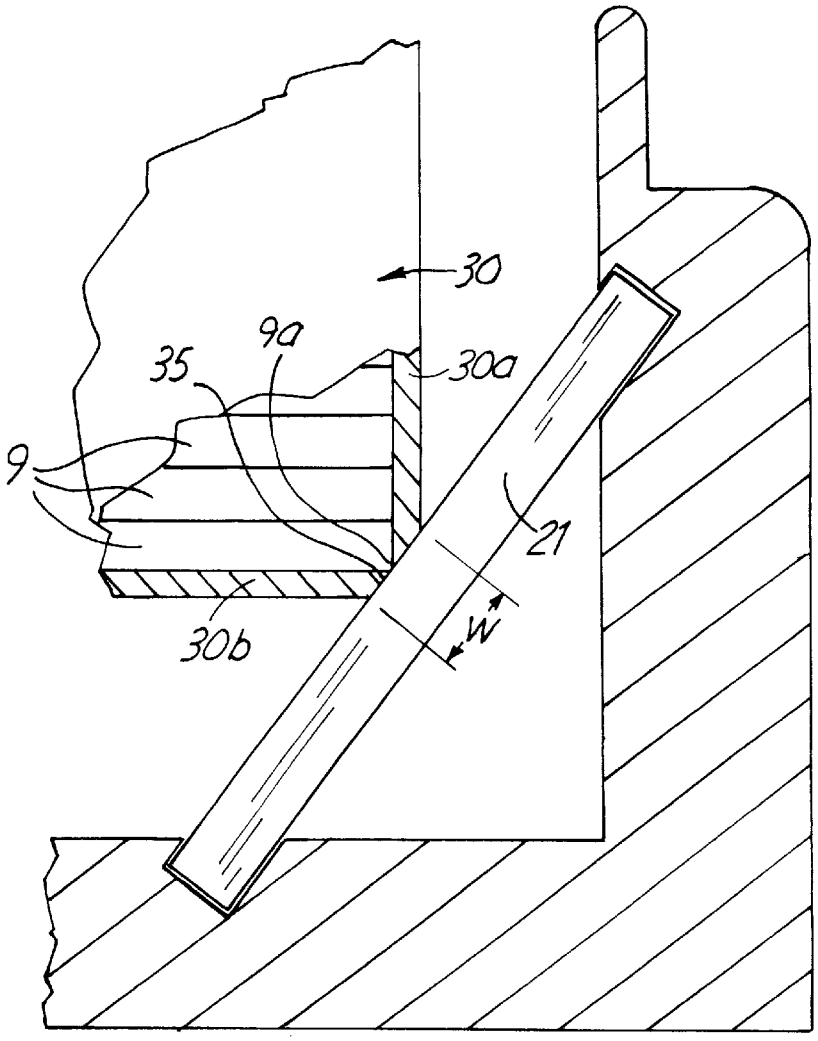
FIG. 5 shows a coin holder with a wrapper being severed between the edge of a coin and a roller.

FIG. 5 shows a coin holder 30 with a wrapper 30*a* being severed between the edge of a coin 9 and a roller 21 and Figure sa shows how the coin holder wrapper 30*a* with the coins 9 therein is positioned so that the edges of the coin wrapper are in engagement with roller 21. As the coin holder is cylindrical and the rollers are spaced at equal arcs of 120 degrees within the coin roller opener, each of the rollers are in simultaneous engagement with all the rotatable rollers 35. The coins 9 are held in position by a conventional wrapper 30*a* that typically is made of paper, foil or the like. The wrapper 30*a* extends down one side of the coin holder 30 and perpendicularly across the flat end 30*b*. The area of pressure contact between roller 21 and coin wrapper 30*a* extends a distance "w". The edge of the coin is indicated by reference numeral 9*a*. As can be seen in FIG. 5, the downward axial force from coin holder 30 causes the wrapper 30*a* to be tightly squeezed by the roller 21. As the area of the roller 21 and the supporting rollers 20 and 22 are relatively small in relation to the coin holder 30, a slight amount of axial force on coin holder 30 crushes the wrapper 30*a* against the edge of coin 9, thereby severing the wrapper.

In operation of the coin holder opener 10 the user rotates the coin holder 30 with respect to coin holder opener 10 causing the rollers 20, 21, and 22 to circumferentially navigate along the edges of the coin wrapper. By applying axial pressure on the coin holder as the coin holder is rotated, it produces a compression of the coin wrapper 30*a* against the edge 9*a* of the coin that enables the coin wrapper 30*a* to be severed by the cutting action of the coin. Thus, with the present invention, the edge of the coin does the cutting of the wrapper thereby eliminating the need for a sharp knife. With the embodiment shown in FIGS. 1–5, the user can hold a roll of coins in one hand and the coin holder opener 10 in the other hand and twist the roll of coins with respect to the coin holder opener to sever the coin holder wrapper and free the coins therefrom.

Figure 6:
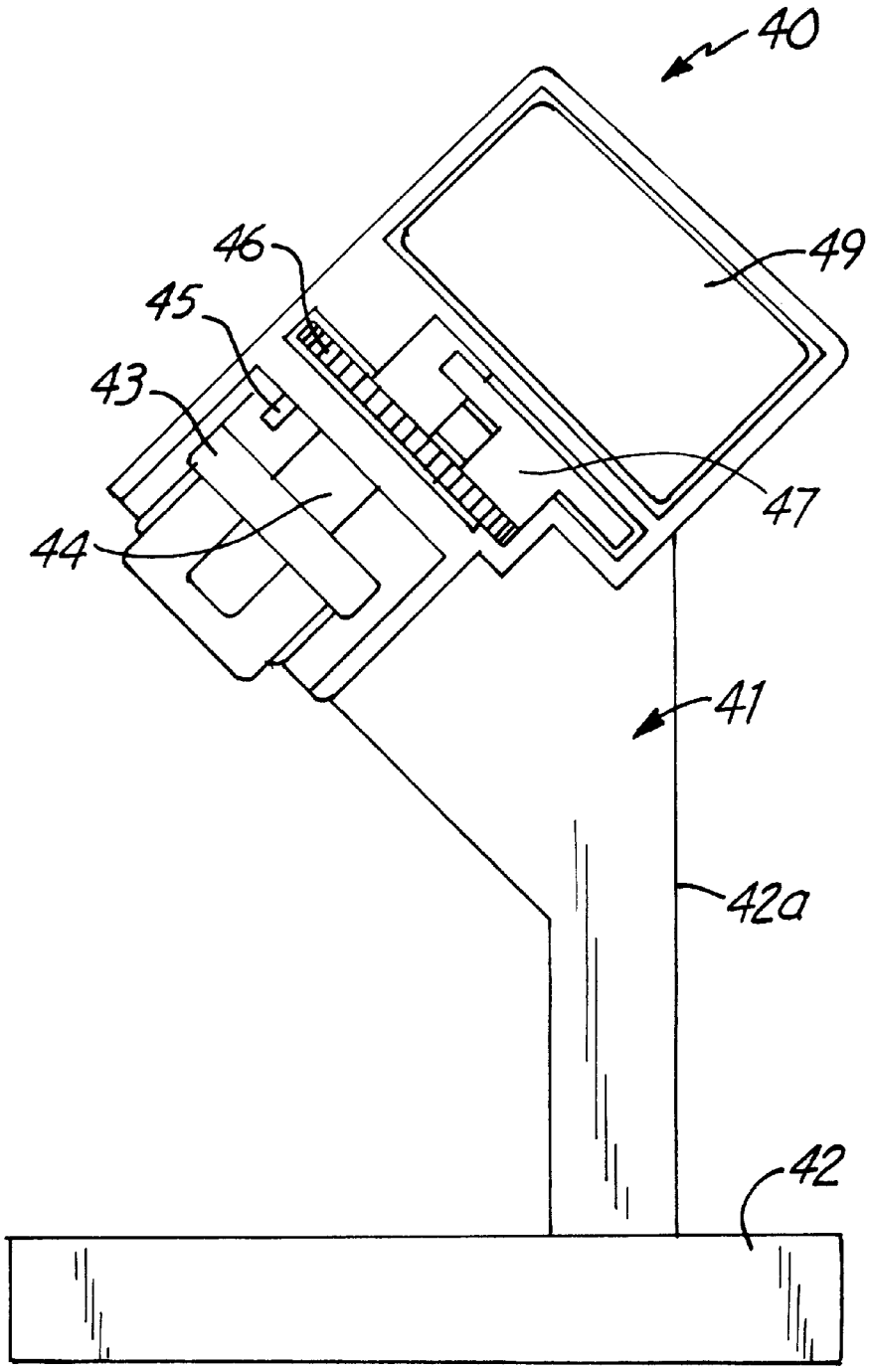
FIG. 6 shows a stand with the coin holder opener rotatably mounted therein.

FIG. 6 shows a power assisted coin holder opener 40 including a stand 41 having a pedestal 42 and an upright 42*a* with a coin holder opener 43 mounted therein. Coin holder opener 43 is similar to coin opener 10 but includes a central shaft 44 that extends inward to a gear 46 that enrages a further gear 47 which in turn is driven by electric motor 49. A electrical switch 45 that is activatable by pushing inward on coin holder opener 43 is located in housing 41 . FIG. 6 illustrates the coin holder opener 40 in the ready condition.

Figure 7:
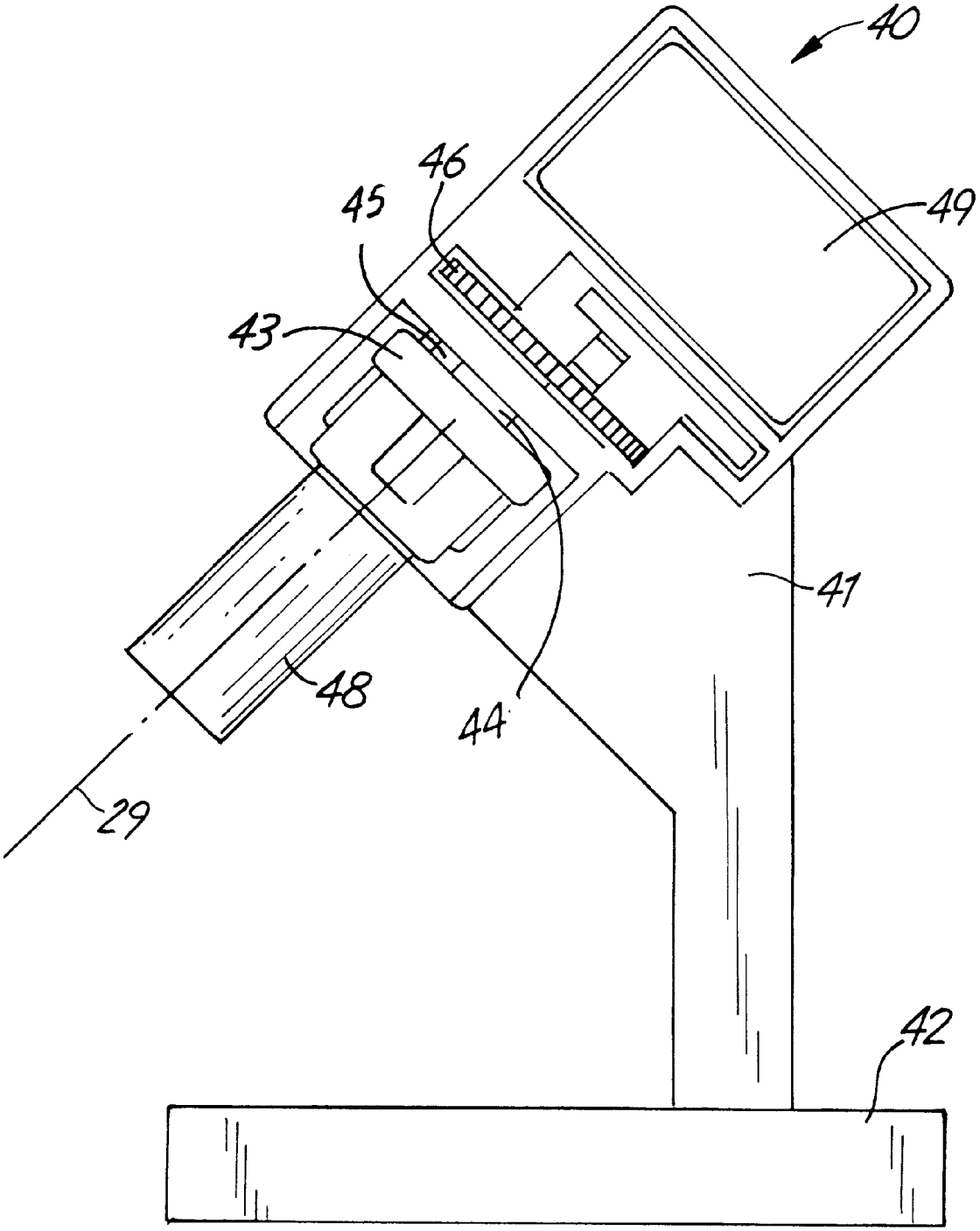
FIG. 7 shows the coin holder opener of FIG. 6 in a cutting condition.

FIG. 7 shows the coin holder opener of FIG. 6 in a cutting condition with a roll of coins 48 inserted into coin holder opener 43. The coin opener 43 has been displaced axially upward so that the switch 45 engages the coin opener 43 thereby closing the circuit causing the motor 49 to rotate the coin opener 43. Consequently, a user need only hold a coin holder 48 in axial contact with coin holder opener 43 to cause the coin opener 43 to rotate with respect thereto and cut open the end of the roll of coins 48. After the cutting is complete, a spring (not shown) pushes the coin holder opener 43 away from switch 45 so that the circuit is interrupted thereby stopping the rotation of the coin holder opener 43.

Figure 8:
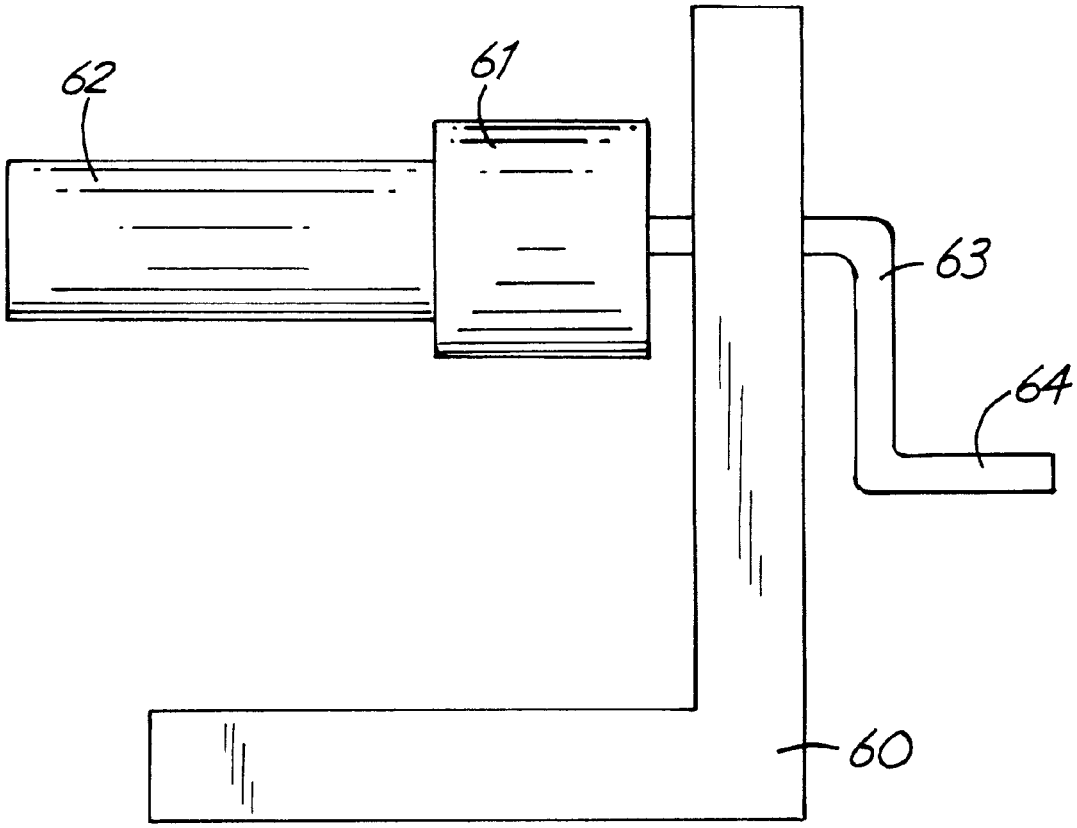
FIG. 8 shows an alternate embodiment wherein the coin holder opener is rotated by a hand crank.

FIG. 8 shows an alternate embodiment wherein the coin holder opener 61 is supported in a stand or bracket 60 having a crank arm 63 that is rotatably mounted bracket 60 with a hand crank 64 thereon. In operation of the device of FIG. 8, the user holds coin holder 62 with one end and axially presses coin roll 62 into coin holder opener 61 while rotating handle 64 thereby causing the rollers located therein to sever the end of the coin roll.

I claim:

1. A coin holder opener comprising;

a housing, said housing having a central axis;

a set of rollers rotatably mounted in said housing, each roller having a first end and a second end, said housing having a base and a sidewall with the first end rotatably supported in the base and the second end rotatably supported in the sidewall each of said rollers in said set of rollers positioned in an acute angle with respect to said axis, each of said rollers in said set of rollers positioned in a spaced relationship from each other and said axis so that when a roll of wrapped coins are inserted into pressure contact with the set of rollers, the rollers and an edge of a coin can compressively cut a coin wrapper therebetween.

2. The coin holder opener of claim 1 wherein the acute angle ranges from 15 to 45 degrees.

3. The coin holder opener of claim 1 including a stand, said stand rotatably supporting said housing; and a crank for rotating said housing.

4. The coin holder opener of claim 1 including a stand, said stand rotatably supporting said housing; and an electric motor for rotating said housing.

5. The coin holder opener of claim 4 including a pressure switch for activating said electric motor so that axial insertion of a roll of coins into the coin holder opener automatically rotates the coin holder opener to sever a wrapper.

6. The coin holder opener of claim 1 wherein the set of rollers includes three rollers.

7. The coin holder opener of claim 1 wherein the housing is a single molded polymer plastic.

8. The coin holder opener of claim I including an information area on said base for holding information.

9. A coin holder opener comprising:

a housing, said housing having a base and a central axis; said base includes protrusions to enable a user to grasp and hold said base; and a set of rollers rotatably mounted in said housing, each of said rollers in said set of rollers positioned at an acute angle with respect to said axis, each of said rollers in said set of rollers positioned in a spaced relationship from each other and said axis so that when a roll of wrapped coins are inserted into pressure contact with the set of rollers, the rollers and an edge of a coin can compressively cut a coin wrapper therebetween.

10. The coin holder opener of claim 9 including a stand and a hand crank for rotating said housing with respect to said stand.

11. The coin holder opener of claim 9 including a motor for rotating said housing.

12. The coin holder opener of claim 9 wherein the set of rollers includes three rollers integrally and rotatably mounted in said housing.

13. The coin holder opener of claim 9 wherein the set of rollers includes three rollers circumferentially spaced at equal angles about said housing.

14. The coin holder opener of claim 9 including a stand having a power source connected thereto to provide for automatic rotating engagement between a roll of coins and the housing.

* * * * *